US010005653B2

(12) United States Patent
Clüsserath et al.

(10) Patent No.: US 10,005,653 B2
(45) Date of Patent: Jun. 26, 2018

(54) FILLING ELEMENT AND FILLING MACHINE

(71) Applicant: KHS GmbH, Dortmund (DE)

(72) Inventors: Ludwig Clüsserath, Bad Kreuznach (DE); Dieter-Rudolf Krulitsch, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 63 days.

(21) Appl. No.: 15/039,275

(22) PCT Filed: Oct. 31, 2014

(86) PCT No.: PCT/EP2014/073443

§ 371 (c)(1),
(2) Date: May 25, 2016

(87) PCT Pub. No.: WO2015/078659

PCT Pub. Date: Jun. 4, 2015

(65) Prior Publication Data

US 2017/0158481 A1 Jun. 8, 2017

(30) Foreign Application Priority Data

Nov. 26, 2013 (DE) ..... 10 2013 113 070

(51) Int. Cl.
*B67C 3/26* (2006.01)
*B67C 3/06* (2006.01)

(52) U.S. Cl.
CPC ..... *B67C 3/26* (2013.01); *B67C 3/06* (2013.01); *B67C 2003/2648* (2013.01); *B67C 2003/2657* (2013.01)

(58) Field of Classification Search
CPC ..... B67C 3/06; B67C 3/26; B67C 2003/266; B67C 2003/2648; B67C 2003/2657
USPC ..... 141/57, 144–147, 269
See application file for complete search history.

(56) References Cited

U.S. PATENT DOCUMENTS 2,063,326 A * 12/1936 Meyer ..... B67C 3/06 137/630.22
3,155,127 A * 11/1964 Hubbard ..... B67C 3/2637 141/245
5,000,234 A * 3/1991 Weiss ..... B67C 3/10 141/40
5,040,574 A 8/1991 Petri
5,295,517 A * 3/1994 Ahlers ..... B67C 3/20 141/1

(Continued)

FOREIGN PATENT DOCUMENTS

DE 41 26 136 2/1993
DE 10 2006 017 706 10/2007

(Continued)

*Primary Examiner* — Timothy L Maust
(74) *Attorney, Agent, or Firm* — Occhiuti & Rohlicek LLP

(57) ABSTRACT

A filling element for filling containers includes a tulip that moves, under the influence of a controller, between two positions, one of which seals the container. A first seal seals a junction between the tulip and a filling-element housing. First and second filling-element regions are respectively outside and inside a clean space of a filling machine. The tulip and a dispensing opening are in the second region. The second seal connects by its first free to the tulip. This second seal seals a junction between the tulip and the two filling-element regions.

20 Claims, 3 Drawing Sheets

(56) References Cited

U.S. PATENT DOCUMENTS

| | | | | | |
|---|---|---|---|---|---|
| 5,413,153 | A * | 5/1995 | Zwilling | B65B 39/004 | 141/302 |
| 5,474,113 | A * | 12/1995 | Rademacher | B67C 3/2608 | 141/116 |
| 7,311,125 | B2 * | 12/2007 | Krulitsch | B67C 3/242 | 141/148 |
| 9,139,312 | B2 * | 9/2015 | Jenne | B65B 3/18 | |
| 2015/0191338 | A1 * | 7/2015 | Krulitsch | B65B 39/001 | 141/129 |

FOREIGN PATENT DOCUMENTS

| | | |
|---|---|---|
| DE | 10 2008 026632 | 12/2009 |
| DE | 10 2012 014 957 | 5/2014 |
| GB | 2 204 306 | 11/1988 |
| WO | WO2008/ 089843 | 7/2008 |

* cited by examiner

FILLING ELEMENT AND FILLING MACHINE

RELATED APPLICATIONS

This is the national stage, under 35 USC 371, of PCT international application PCT/EP2014/073443, filed on Oct. 31, 2014, which claims the benefit of the Nov. 26, 2013 priority date of German application DE 102013113070.4, the contents of which are herein incorporated by reference.

FIELD OF INVENTION

The invention relates to container processing, and in particular, to a filling element for filling cans or similar containers.

BACKGROUND

Filling machines for filling, in particular for the pressure-filling of containers in the form of cans with liquid contents (for example beer, soft drinks etc.) are known in a variety of embodiments. Especially with filling machines with a high throughput (number of filled containers per unit of time), it is customary for the sealed contact between the filling element and the respective container that is arranged beneath a filling element on or at a container carrier to be achieved by lowering down onto the container a sealing tulip that is then in sealed contact with a seal against the edge of the opening of the container concerned, so creating a space that encloses the container opening and the dispensing opening of the filling element and that is sealed to the exterior.

The sealing tulip that is formed by an annular body is disposed on a portion of the filling element housing so as to be displaceable, parallel to a filling element axis, between a raised position and the lowered position. The displacement of the sealing tulip is preferably effected in a controlled manner by a controller formed, in particular, by control rods.

Filling machines that comprise a clean space that is separated from the environment and in which the actual filling of the containers takes place are known, in particular, for the ultra-pure filling of containers. In these machines, the filling elements extend in part at least into the clean space from a region where the purity requirements are less stringent. More particularly, the controllers are mechanically actuated by an actuating device outside the clean space, whereas the sealing tulip that is to be moved is inside the clean space. It is therefore necessary for the controllers to extend from the region where the purity requirements are less stringent into the clean space, i.e. to penetrate the interface between these regions. The separation between these two regions can be compromised by the presence of these penetrations.

SUMMARY

An object of the invention is to provide a filling element that facilitates an optimized separation of the clean space from the region with less stringent purity requirements, and hence an ultra-pure filling of the contents.

The invention relates first to a filling element for the filling of cans or similar containers with liquid contents. The filling element comprises a filling element housing that has at least one dispensing opening on a housing portion for the controlled dispensing of the contents into the respective container. The filling element also comprises a sealing tulip that can be moved relative to the housing portion by way of at least one controller parallel to the filling element axis between a raised position and a lowered position in which the sealing tulip is in a sealed position up against an opening edge of the container. The sealing tulip is connected to the filling element housing by way of a first sealing element in order to seal the transition between the sealing tulip and the filling element housing, with the first sealing element being provided between the housing portion and the controller. The first sealing element is preferably provided at a distance away from the housing portion and extends, again preferably, along the controller. The filling element also comprises a first filling element region that is arranged outside a clean space of a filling machine, and a second filling element region that comprises the sealing tulip and the dispensing opening and that is inside a clean space of a filling machine. A second sealing element, which is connected to the sealing tulip by a first free end, is also provided. This second sealing element surrounds the outer periphery of the first sealing element radially outside the controller and seals the transition between the sealing tulip and the interface between the first and second filling element region. This arrangement ensures that, in the region between the sealing tulip and the interface, the controller are completely separated from the clean space and that a contamination of the clean space through the penetration of the controller from the region outside the clean space into the clean space is prevented.

In another embodiment, the sealing tulip and the first sealing element surround the outer or enveloping surface of the housing portion, forming an annular gap between the outer surface of the housing portion and an inner surface of the sealing tulip and of the first sealing element. On the one hand, this arrangement ensures that there is no sliding of the first sealing element on the housing portion, thus obviating the need for lubrication by, for example, a lubricant or anti-friction agent. On the other hand, placing the housing portion at a distance away from the sealing element significantly reduces the accumulation of bacteria in the annular gap.

In another embodiment, the second sealing element surrounds the first sealing element concentrically or essentially concentrically. The second sealing element may also be arranged at a distance away from the first sealing element so as to provide an annular interspace.

The first and second sealing elements are configured preferably as tube-like sealing elements whose lengths can be expanded and compressed. The sealing elements each comprise a median longitudinal axis running parallel with one another or joining in a common median longitudinal axis.

In another embodiment, a partial length of the controller is provided in the interspace between the first and second sealing element. This ensures that the moveable, more particularly displaceable, controller with the partial length extending into the clean space is surrounded on both sides by the sealing elements. This results in a separation from the clean space.

In another embodiment, a positive pressure is applied to the interspace between the first and second sealing element. The positive pressure is preferably above atmospheric pressure, i.e. the pressure present within the environment around the filling element. This effectively prevents ingress of bacteria. The positive pressure stabilizes the form of the sealing elements. In particular, it stabilizes the form of the first sealing element. The positive pressure is generated preferably by way of a sterile or inert gas.

In another embodiment, a pressure sensor monitors the positive pressure in the interspace between the first and second sealing elements. This enables the pressure prevailing in the interspace to be determined and a test for any leaks to be carried out.

In another embodiment, a negative pressure is applied to the interspace between the first and second sealing elements. The advantage of this approach is that, in the event of a leak, no substances or gases could pass from the interspace between the first and second sealing element into the clean space. This reliably prevents contamination of the clean space.

In another embodiment, the controller is guided, at least for a section, in the filling element housing, with the controllers being control rods, for example. This guiding takes place preferably in the central region of the controller and, again preferably, over a partial length greater than half the controller section that projects out of the clean space. This ensures that the control rods can be dimensioned with a reduced cross-section.

In another embodiment, the second sealing element connects to the filling element housing by its second free end facing away from the sealing tulip. As a result, the interspace between the first and second sealing element is sealed at the top by the filling element housing. A channel can be provided in the filling element housing for feeding a pressurized medium, such as a gas, by which the interspace is pressurized.

In another embodiment, at least two controllers are distributed about the filling element axis. Partial lengths of these controllers are preferably provided in the interspace between the first and second sealing elements. The use of a plurality of distributed controllers ensures safe, tilt-free vertical displacement and a distribution of the pressing forces upon the container around the periphery of the sealing tulip even without any sliding guidance of the sealing tulip.

In another embodiment, the first and/or second sealing element is a bellows.

In another embodiment, the housing portion is configured on its outer or enveloping surface in the form or essentially in the form of a circular cylinder. As a result the outer or enveloping surface can be cleaned more easily and, in particular, can be rinsed in a CIP process.

In another embodiment, at least one channel for introducing a cleaning agent opens into the annular gap. In this way, the sealing element that delimits the annular gap on a first side, and the housing portion that delimits the annular gap on the opposite second side, can be rinsed clean. Preferably, the channel for introducing a cleaning medium opens at an end of the channel furthest from the sealing tulip into the annular gap such that the cleaning agent flows through the annular gap over its entire length. More particularly, the cleaning agent can be introduced at an angle to the filling element axis such that the cleaning agent flows through the annular gap along a meandering path or along a spiral line.

According to another aspect, the invention relates to a filling machine for filling cans or similar containers with liquid contents and having a plurality of filling elements provided on a rotating transport element such as a rotor rotating about a vertical machine axis for example. The filling elements of the filling machine are configured as described above.

More particularly however, the filling element is not designed exclusively for the pressure-filling of cans or similar containers. It can also be used for any pressurized filling with a high throughput. The filling element is also suitable for open-jet filling at ambient pressure, for example.

The term "pressure-filling" is to be understood generally to mean a filling method in which the container to be filled lies in sealed position against the filling element and usually before the actual filling phase, i.e. before the liquid valve is opened, is pre-tensioned through at least one controlled gas path configured in the filling element with a pressurized pre-tensioning gas (inert gas or CO2 gas) which the contents entering the container during filling increasingly displace as a return gas out of the container interior, again through at least one controlled gas path configured in the filling element. This pre-tensioning phase may be preceded by other treatment phases, for example, by an evacuation and/or a purging of the container interior with an inert gas such as CO2, water vapor etc., here again through the gas paths configured in the filling element.

The expression "container in sealed position with the filling element" means that the respective container that is to be filled lies with its container mouth pressed seal-tight up against the filling element or against the local sealing tulip.

The expressions "essentially", "in essence" or "around" mean variations from the respective exact value by ±10%, preferably by ±5% and/or variations in the form of changes insignificant for the function.

Further embodiments, advantages, and possible applications of the disclosed structure arise out of the following description of embodiments and out of the figures. All of the described and/or pictorially represented attributes whether alone or in any desired combination are fundamentally the subject matter of the invention independently of their synopsis in the claims or a retroactive application thereof. The content of the claims is also made an integral part of the description.

BRIEF DESCRIPTION OF THE DRAWINGS

The invention is explained in detail below through the use of an embodiment example with reference to the figures, in which.

DETAILED DESCRIPTION

Figure 1:
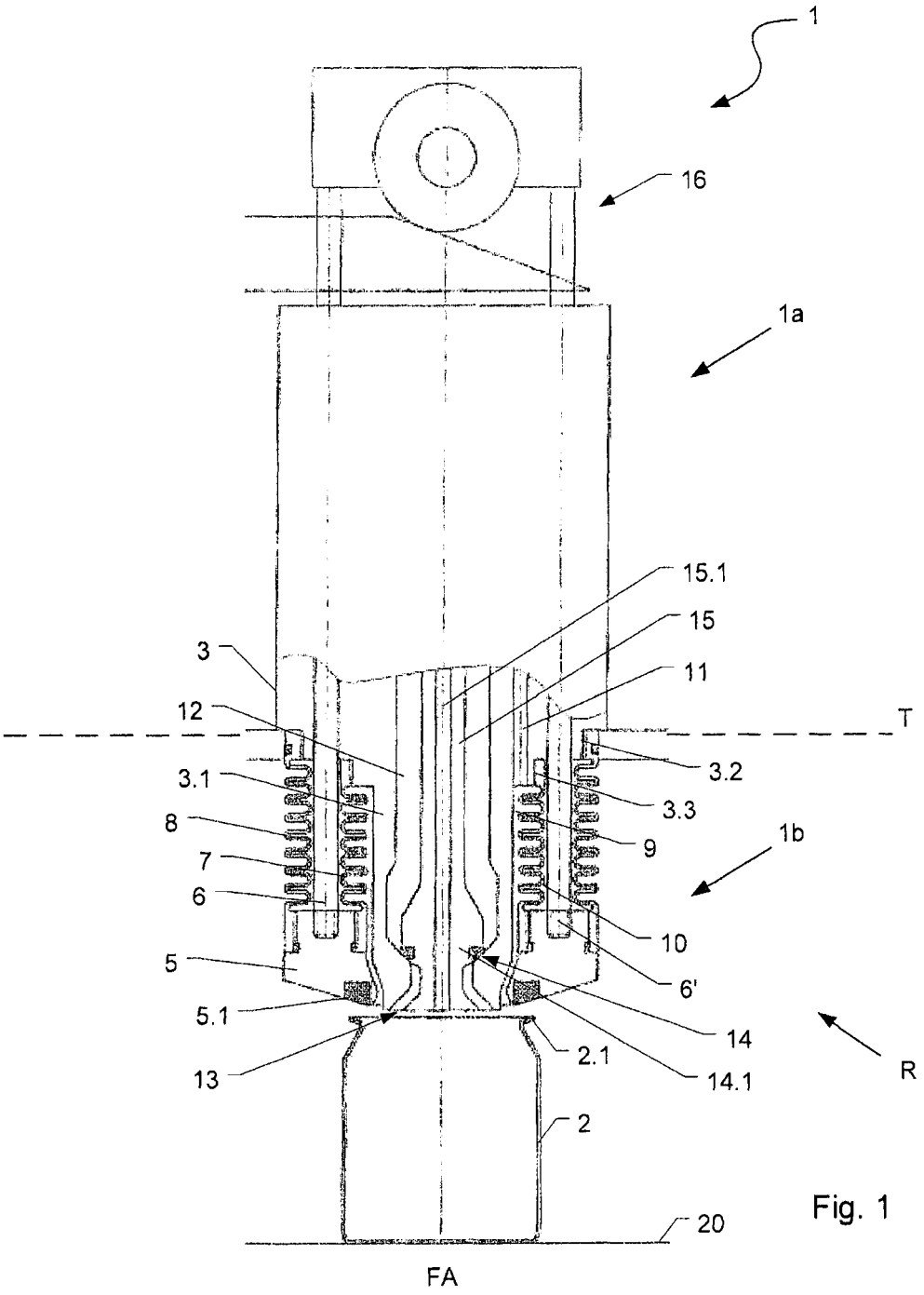
FIG. 1 shows, in simplified view and partial section, a filling element together with a container that is to be filled, with the sealing tulip raised.
Figure 2:
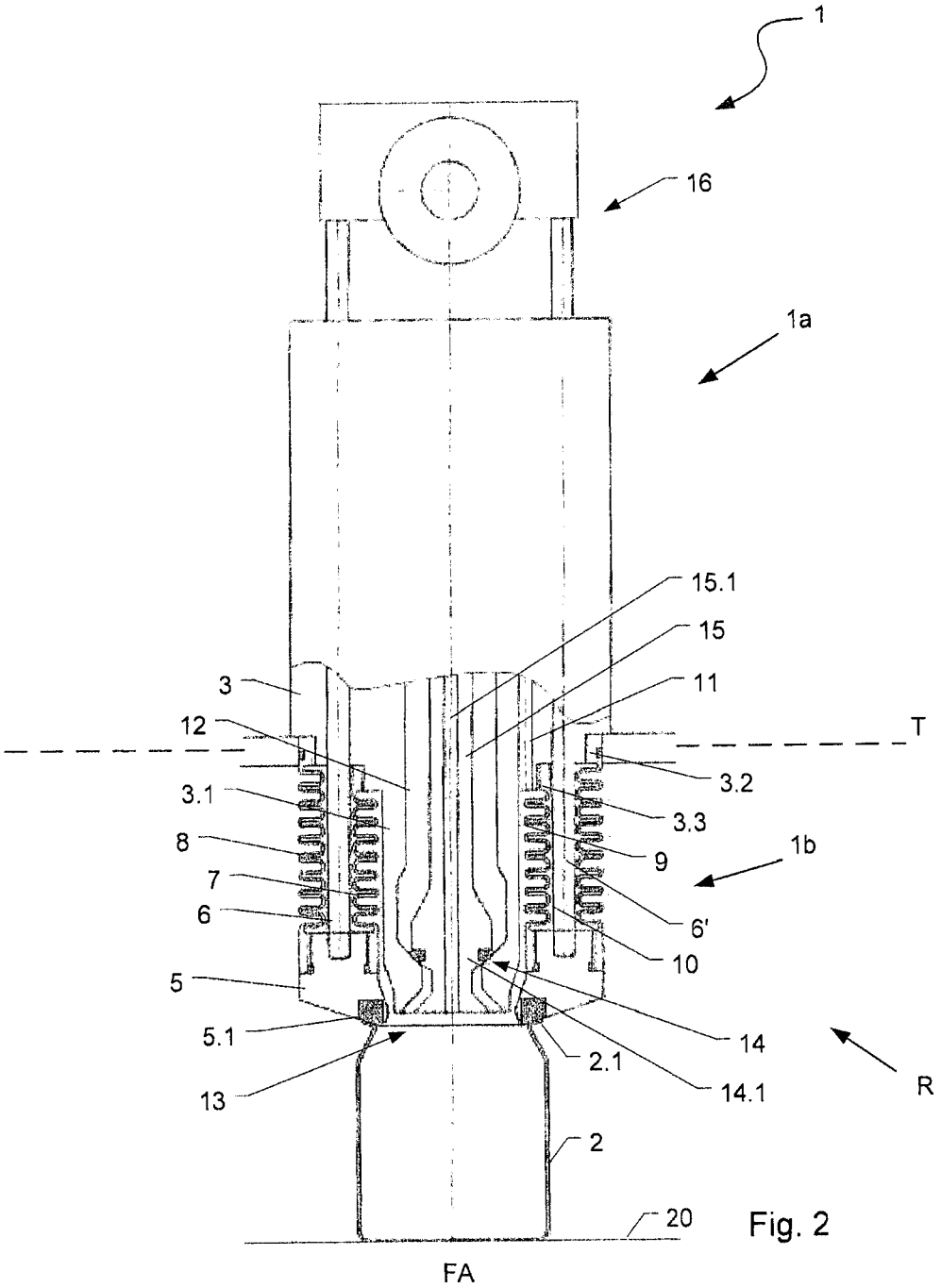
FIG. 2 shows, in simplified view and partial section, a filling element together with a container that is to be filled, with the sealing tulip lowered.

FIGS. 1 and 2 show a filling position of a filling machine for the pressure-filling of containers 2. In the illustrated embodiment, the containers are cans. The contents are typically carbonated. Examples include beer or soda.

The filling position comprises a filling element 1 that, together with a plurality of identical filling elements, is disposed on the periphery of a rotor driven to rotate about a vertical machine axis. Under the filling elements 1, there is provided a platform 20 on the rotor. Upon this platform 20, containers 2 that are to be filled stand upright on their base. Alternatively the containers can also be suspended.

Each filling element 1 comprises a liquid channel 12 that passes through a filling element housing 3. At its upper region, the liquid channel 12 connects to a tank on the rotor that is common to and supplies content for all filling elements 3. At the lower end of the filling-element housing 3 is an annular dispensing opening 13 through which the contents can flow out of liquid channel 12 and into container 2.

A liquid valve 14 is provided in the liquid channel 12 upstream of the dispensing opening 13 in the direction of flow of the contents. The liquid valve 14 comprises a valve body 14.1 that interacts with a valve seat in the liquid channel 12 and that is configured in the region of a lower end of a gas tube 15 that serves as the valve body 14.1. Together with gas tube 15, which is arranged with its axis on a filling element axis FA that is oriented parallel to the machine axis and that is more particularly a vertical filling element axis, and in which is formed a gas channel 15.1 open at the underside of the filling element 3, the valve body 14.1 is raised by an actuating device from its closed position, shown in FIGS. 1 and 2, in order to open the liquid valve 14 and lowered again in order to close the liquid valve 14.

In its lower region, the filling element housing 3 forms a tube-like housing portion 3.1 with a reduced diameter. A sealing tulip 5, which can be moved in the direction of filling element axis FA, is provided on this housing portion 3.1, on which dispensing opening 13 and the valve seat for liquid valve 14 are also provided.

The sealing tulip 5 is configured as an annular body that surrounds the housing portion 3.1 and that, at a lower annular body portion, is provided on its end face with a ring seal 5.1 concentrically surrounding the filling element axis FA. Once the sealing tulip 5 has been lowered down onto an opening edge 2.1 of container 2, the ring seal 5.1 creates a seal-tight connection between the interior of the container 2 and the sealing tulip 5. The sealing tulip 5 may also be tapered such that lowering down onto the container 2 simultaneously centers the container 2 relative to the filling element.

A first sealing element 7, which surrounds the housing portion 3.1 above the sealing tulip 5, seals the transition or junction between the sealing tulip 5 and the filling element housing 3. The first sealing element 7 connects, by its first upper free end, which lies further from the dispensing opening 13 to the filling element housing 3. It connects, by its lower free end, which lies nearer to dispensing opening 13, to the sealing tulip 5, and more particularly, to an upper side of sealing tulip 5 that faces away from the ring seal 5.1. The first sealing element 7 is produced from a suitable elastic and/or flexible material, such as PTFE (polytetrafluoroethylene). In some embodiments, the first sealing element 7 is a bellows. In other embodiments, the first sealing element 7 is a concertina-shaped tube having a plurality of folds. As shown in FIGS. 1 and 2, both the sealing tulip 5 and the first sealing element 7 surround the housing portion 3.1 at a distance. This creates an annular gap 9.

At least one controller 6, 6' for moving the sealing tulip 5 is provided radially, relative to the filling element axis FA, outside the first sealing element 7. In the embodiment shown, the controller 6, 6' is a rod extending parallel to and radially offset from the filling element axis FA. In the illustrated embodiment, two controllers 6, 6' are disposed so as to be diametrically opposed to one another relative to filling element axis FA.

The controllers 6, 6' each connect to the sealing tulip 5 by lower free ends thereof. By their upper ends, which are opposite their lower free ends, the controllers 6, 6' couple to an actuator 16.

In the illustrated embodiment, the actuator 16 is formed by a cam control. Other forms of actuator 16 can also be provided. These include hydraulic or pneumatic actuators. The controllers 6, 6' are held on the filling element 1 so as to be axially displaceable and such that sealing tulip 5 can be moved axially when the actuator 16 initiates a lifting motion of the controllers 6, 6'.

The filling element 1 is particularly suitable for use in a filling machine for the ultra-clean filling or aseptic filling of containers 2. More particularly, the filling element 1 is configured for use in a filling machine for filling cans. For this purpose, the filling element 1 comprises an upper filling element region 1*a* and a lower filling element region 1*b*, with the upper filling element region 1*a* being outside a clean space R and the lower filling element region 1*b* being inside the clean space R. The filling of containers 2 takes place inside the clean space. The lower filling element region 1*b* comprises a dispensing opening 13 for the contents and the sealing tulip 5. An interface T separates the clean space R from the region above it, in which less stringent purity requirements apply. The interface T forms the boundary between the clean space R and the region above it, which has the less stringent purity requirements. A separating device that separates clean space R from the region above it, which has the less stringent purity requirements, can be provided at the interface T.

A first partial length of a controller 6, 6' that operates the sealing tulip 5 is accommodated in the clean space R.A second partial length projects into the region above it, which is the region that has the less stringent purity requirements. To avoid the penetration of the interface T by the controller 6, 6' causing an unwanted connection between the clean space R and the region above it, which would compromise the purity conditions in the clean space R, a second sealing element 8 is provided, which, like the first sealing element 7 is preferably configured as a bellows and consists of an elastic and/or flexible material such as PTFE. At a first free end thereof, the second sealing element 8 connects to the sealing tulip 5 and extends in a direction parallel to the filling element axis FA into the region of the interface T. The second sealing element 8 is preferably configured in the as a tube that peripherally encloses both the first sealing element 7 and the controllers 6, 6' over their partial length, which projects into the clean space R. It is particularly preferable if the second sealing element 8 is arranged concentrically about the filling element axis FA. In its interior, the second sealing element 8 accommodates a partial length of the housing portion 3.1 as well as the first sealing element 7 and a partial length of the controllers 6, 6'. This ensures that, even with partial lengths of the axially displaceable controllers 6, 6' projecting into the clean space R, the separation between the clean space R and the region above it is maintained.

It is preferable that the second free end of the second sealing element 8, which lies opposite the sealing tulip 5, be connected to the filling element housing 3, i.e. the interface T between the clean space R and the region above it.

It is also preferable that the filling element housing 3 be configured so as to have multiple stages within the transitional region between the first filling element region 1*a* and the second filling element region 1*b*, i.e. in the transitional region between the region with the less stringent purity requirements and the clean space R. In particular, a first stage 3.2 is provided on which the upper second free end of the second sealing element 8 is disposed. Offset radially inwards from the first stage 3.2 is provided a further second stage 3.3 on which the upper free end of first sealing element 7 is provided. A penetration for the controllers 6, 6' is provided at the level that lies between the first and second stages 3.2, 3.3 and on which the filling element axis FA stands perpendicularly. That is to say, the controllers 6, 6' run in a region that is enclosed by the first and second sealing element 7, 8. This ensures that those partial lengths of the controllers 6, 6' that project into clean space R are enclosed by the first and second sealing element 7, 8 in such a way that there is no communication with the clean space R.

It is also preferable that the controllers 6, 6' be slide-guided in the first filling element region 1*a* in the filling element housing 3, i.e. that they slide in holes provided therein and that run parallel to the filling element axis FA. The length of the slide guide in the filling element housing 3 is preferably more than half of that partial length of the controller 6, 6' that extends outside the clean space R. This ensures that the controllers 6, 6' can be dimensioned with a reduced cross-section, since only minimal bending forces occur because of the long slide guide.

A channel 11, which during the CIP cleaning of the filling machine and of its filling elements 1 serves, for example, to introduce, into the annular gap 9, a liquid cleaning and/or sterilization medium, which then also flows over the entire axial length of the annular gap 9 for cleaning and/or sterilizing the inner faces of the first sealing element 7, opens out into an upper region of the annular gap 9, which is formed between the first sealing element 7 and the outer surface of the housing portion 3.1. The channel 11 may, for example, also be used to wash and/or pre-tension a container that is already present in the sealed position at the filling position.

In order to fill a container 2 that has been arranged with its container opening beneath the filling element 1, the sealing tulip 5 is first lowered along the filling element axis FA down onto the container 2, as shown in FIG. 2. In this state, the ring seal 5.1 forms a seal against the opening edge 2.1. As a result, the container 2 is now present centered on and sealed with the filling element 1.

Prior to the actual filling, the container 2 that is in sealed against the filling element 1 is pre-tensioned, via the gas channel 15.1, for example, with a pressurized inert gas, for example with pressurized CO2 gas. After pre-tensioning, opening the liquid valve 14 begins the actual filling phase. The filling material that enters then displaces the inert gas out of the container 2 via the gas channel 15.1.

Figure 3:
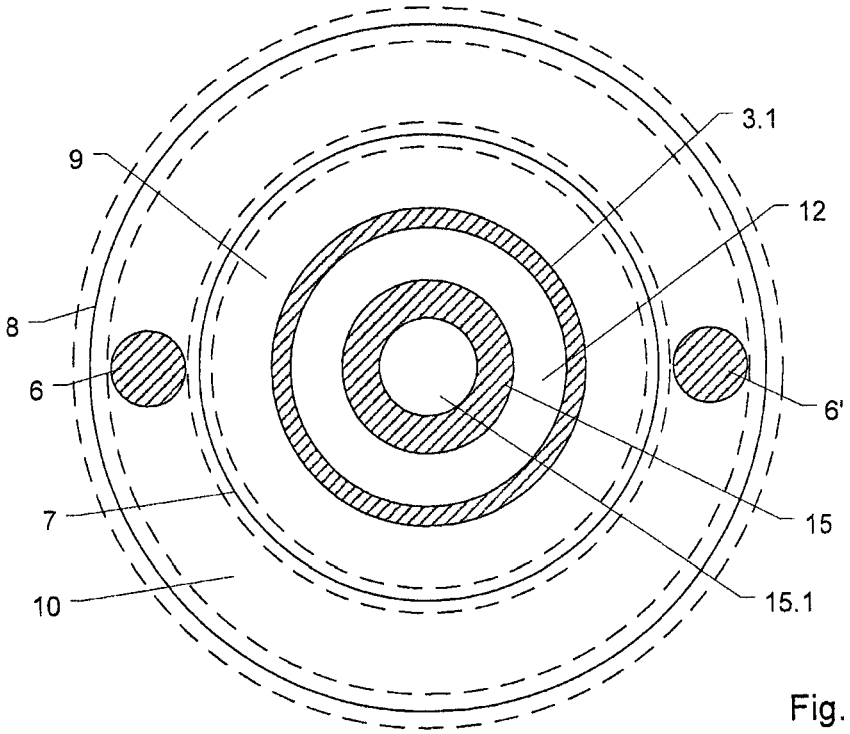
FIG. 3 shows a section along the horizontal sectional plane of the filling element according to FIG. 1.

FIG. 3 shows a section along the line B-B' shown in FIG. 1. In particular, FIG. 3 shows the concentric configuration of the filling valve 1 in the region of the housing portion 3.1.

As shown in FIG. 3, the central gas tube 15, which encloses the concentric gas channel 15.1, is itself enclosed at a distance by the housing portion 3.1, which is configured as a tube. This results in an annular liquid channel 12 between the gas tube 15 and the housing portion 3.1. The housing portion 3.1 is in turn enclosed at a distance by the first sealing element 7, which preferably has an annular cross-section. The annular gap 9 results from the distance that is left between the first sealing element 7 and the housing portion 3.1.

The second sealing element 8 is disposed around the outside of first sealing element 7. The second sealing element 8 preferably has an annular cross-section and entirely surrounds the outer periphery of the first sealing element 7. The distance between the first and second sealing element 7, 8 creates between them an annular interspace 10 that extends axially parallel to the filling element axis FA, which it preferably concentrically encloses.

The controllers 6, 6' are provided in this interspace 10. The partial lengths of the controllers 6, 6', which project into the clean space R, are completely separated from the clean space R by the connection of the lower free ends of the sealing elements 7, 8 to the sealing tulip 5 and the connection between the upper free ends of the sealing elements 7, 8 to the filling element housing 3 or to elements arranged on the filling element housing 3.

A channel that is configured in the filling element housing 3 and by way of which a pressurized medium, especially a pressurized gas, can be fed to the interspace 10, can terminate in the interspace 10, more particularly at the top thereof. A pressure sensor, by which the pressure in the interspace 10 can be measured, may also be provided. An ingress of bacteria into the interspace 10 can be effectively prevented by the introduction of a pressurized medium into the interspace 10, with the pressure present in the interspace being preferably above atmospheric pressure, The pressure in the interspace 10 can preferably be selected such that it stabilizes the form of the first sealing element 7. During and/or prior to the filling process, when the container 2 is pre-tensioned, an undesirable distortion of the first sealing element 7 can occur, especially when the container 2 is filled at high filling pressures. The application of pressure to the interspace 10 creates a counter-pressure that counteracts the distortion of the first sealing element 7 and effectively prevents or at the least minimizes it.

The invention has been described hereinbefore by reference to one embodiment. It goes without saying that numerous variations as well as modifications are possible without departing from the inventive concept underlying the invention.

The invention claimed is:

1. A filling element for filling containers with liquid contents, said filling element comprising a filling element housing that has at least one dispensing opening on a housing portion for the controlled dispensing of the liquid contents into a container and a sealing tulip that, by way of a controller, can be moved relative to the housing portion parallel to a filling element axis between a raised position and a lowered position in which the sealing tulip lies in sealed position with an opening edge of the container, with the sealing tulip being connected to the filling element housing by a first sealing element to seal a junction between the sealing tulip and the filling element housing, with the first sealing element being provided between the housing portion and the controller, and with the filling element comprising a first filling element region that is arranged outside a clean space of a filling machine, and a second filling element region that comprises the sealing tulip and the dispensing opening and that is arranged in a clean space of a filling machine, wherein a second sealing element is connected by a first free end to the sealing tulip, surrounds an outer periphery of the sealing element radially outside the control means, and seals the junction between the sealing tulip and an interface between the first and second filling element region formed by a separating device.

2. The filling element of claim 1, wherein the sealing tulip and the first sealing element surround the housing portion on its outer or enveloping surface while forming an annular gap between the outer surface of the housing portion and an inner surface of the sealing tulip and of the first sealing element.

3. The filling element of claim 1, wherein the second sealing element surrounds the first sealing element concentrically or essentially concentrically.

4. The filling element of claim 1, wherein at least a partial length of the controller is provided in an interspace located between the first and second sealing element.

5. The filling element claim 4, wherein a positive pressure or a negative pressure can be applied to the interspace located between the first and second sealing element.

6. An apparatus comprising a filling element for causing liquid content to fill a container that has an edge, wherein said filling element extends along a filling-element axis, wherein said filling element comprises a first filling-element region, a second filling-element region, a filling-element housing, a sealing tulip, a first sealing-tulip controller, a first seal, a second seal, and an interface, wherein said filling-element housing comprises a filling-element housing portion, wherein said dispensing opening is on said filling-element housing portion, wherein said dispensing opening is configured to cause controlled dispensing of said liquid content into said container, wherein said first sealing-tulip controller moves said sealing tulip relative to said filling-element housing portion along a direction that is parallel to said filling-element axis, wherein said first sealing-tulip controller moves said sealing tulip between a raised position and a lowered position, wherein, in said lowered position, said sealing tulip lies sealed with said opening edge of said container, wherein said sealing tulip is connected to said filling-element housing by said first seal in order to seal a junction between said sealing tulip and said filling-element housing, wherein said first seal is disposed between said filling-element housing portion and said first sealing-tulip controller, wherein said first filling-element region is outside a clean space of a filling machine, wherein said second filling-element region comprises said sealing tulip and said dispensing opening, wherein said second filling-element region is arranged in said clean space, wherein said second seal is connected by a first free end thereof to said sealing tulip, wherein said second seal surrounds an outer periphery of said seal radially outside said first sealing-tulip controller, wherein said second seal seals a junction between said sealing tulip and said interface, wherein said interface is between said first filling-element region and said second filling-element region, and wherein said interface is formed by a separating device.

7. The apparatus of claim 6, wherein said sealing tulip and said first sealing element surround an outer surface of said filling-element housing portion, thereby forming an annular gap between said outer surface and an inner surface of said sealing tulip and of said first seal.

8. The apparatus of claim 6, wherein said second seal surrounds said first seal, and wherein said first and second seals are concentric.

9. The apparatus of claim 6, further comprising an interspace between said first seal and said second seal, wherein said first sealing-tulip controller has a portion that is disposed within said interspace.

10. The apparatus of claim 6, further comprising an interspace between said first seal and said second seal, wherein said interspace is pressurized.

11. The apparatus of claim 10, wherein said interspace is negatively pressurized.

12. The apparatus of claim 6, further comprising a pressure sensor disposed for monitoring a pressure within an said interspace between said first and second seal.

13. The apparatus of claim 6, wherein at least a section of said first sealing-tulip controller is guided in said filling-element housing.

14. The apparatus of claim 6, wherein said second seal is connected to said filling-element housing by a second free end thereof, said second free end being furthest from said sealing tulip.

15. The apparatus of claim 6, further comprising a second sealing-tulip controller, wherein said first and second sealing-tulip controllers are distributed about said filling-element axis.

16. The apparatus of claim 6, wherein at least one of said first seal and said second seal comprises a bellows.

17. The apparatus of claim 6, wherein said filling-element housing portion is cylindrical.

18. The apparatus of claim 6, further comprising a channel for introducing a cleaning agent into an annular gap between seal sealing tulip and said filling-element housing portion.

19. The apparatus of claim 18 wherein said channel opens out into said annular gap at a channel end furthest away from said sealing tulip.

20. The apparatus of claim 6, further comprising a rotor that rotates about a vertical machine axis, wherein said filling element is one of a plurality of identical filling elements disposed along a periphery thereof.

* * * * *